US005396743A

United States Patent [19]

Bellette

[11] Patent Number: 5,396,743

[45] Date of Patent: Mar. 14, 1995

[54] ANCHORAGE DEVICE FOR USE IN SAND OR SANDY SOILS

[76] Inventor: Rodney W. Bellette, Loddon Valley Highway, Gladfield via Pyramid Hill, Victoria, Australia, 3575

[21] Appl. No.: 39,346

[22] PCT Filed: Oct. 15, 1991

[86] PCT No.: PCT/AU91/00475

§ 371 Date: Jun. 14, 1993

§ 102(e) Date: Jun. 14, 1993

[87] PCT Pub. No.: WO92/06610

PCT Pub. Date: Apr. 30, 1992

[30] Foreign Application Priority Data

Oct. 22, 1990 [AU] Australia ..... PK2920
Jan. 17, 1991 [AU] Australia ..... PK4264

[51] Int. Cl.[6] ..... E02D 5/80; E04H 12/22; A45F 3/44

[52] U.S. Cl. ..... 52/154; 52/155; 52/160; 52/165; 248/530; 248/545; 135/118

[58] Field of Search ..... 52/153–156, 52/158, 160, 165; 248/156, 530, 545; 135/118

[56] References Cited

U.S. PATENT DOCUMENTS 1,153,450 9/1915 Schaff ..... 52/155
1,879,414 9/1932 Munoz ..... 52/165 X
3,887,154 6/1975 Cornett ..... 52/165 X
4,649,678 3/1987 Lamson ..... 52/165 X
4,832,304 5/1989 Morgulis ..... 248/533

FOREIGN PATENT DOCUMENTS 7866775 9/1976 Australia .
3541178 11/1979 Australia .
1282047 7/1972 United Kingdom .
1365390 9/1974 United Kingdom .

*Primary Examiner*—Carl D. Driedman
*Assistant Examiner*—Robert Canfield
*Attorney, Agent, or Firm*—Knobbe, Martens, Olson & Bear

[57] ABSTRACT

An anchorage device for use in sand or sandy soils. The device comprises a shank portion (2) and a spike portion (4) at a lower end of the shank portion. The spike portion (4) comprises a first and second pair of downwardly convergent plates (6,18), the second pair of plates (18) extending from a position above the upper ends of the first plates (6) to a position beneath the upper ends of the first plates to funnel sand into the zone between the interior surfaces of the first plates (6). The sand thereby trapped between the plates anchors the spike portion (4) within the ground. The device may be used for example for anchoring beach umbrellas, tents and fences in sand or sandy soil.

14 Claims, 4 Drawing Sheets

ANCHORAGE DEVICE FOR USE IN SAND OR SANDY SOILS

The present invention relates to an anchorage device for use in sand or sandy soils.

A requirement exists for an anchorage device which can be set into sand or sandy soil to provide a secure anchorage therein. Anchorage devices for beach umbrellas and the like have been prepared in the form of a coarse screw thread at the end of the shaft of the umbrella. The device screws into the sand and provides a degree of anchorage, but not a firm anchorage and can easily be displaced.

According to the present invention, there is provided an anchorage device for use in sand or sandy soils, said device. comprising a shank portion and a spike portion at a lower end of the shank portion, said spike portion comprising a first pair of downwardly convergent plates, said device further comprising a second pair of downwardly convergent plates extending from a position above the upper ends of the first plates to a position beneath the upper ends of the first plates to funnel sand into the zone between the interior surfaces of the first plates.

In a preferred embodiment, the first and second pairs of plates are mounted on a substantially planar web, with the plates extending perpendicularly to the web and on opposite sides of the web.

Advantageously the upper ends of the second plates are outwardly flared.

Embodiments of the invention will now be described, by way of example only, with reference to the accompanying drawings, in which.

Figure 1:
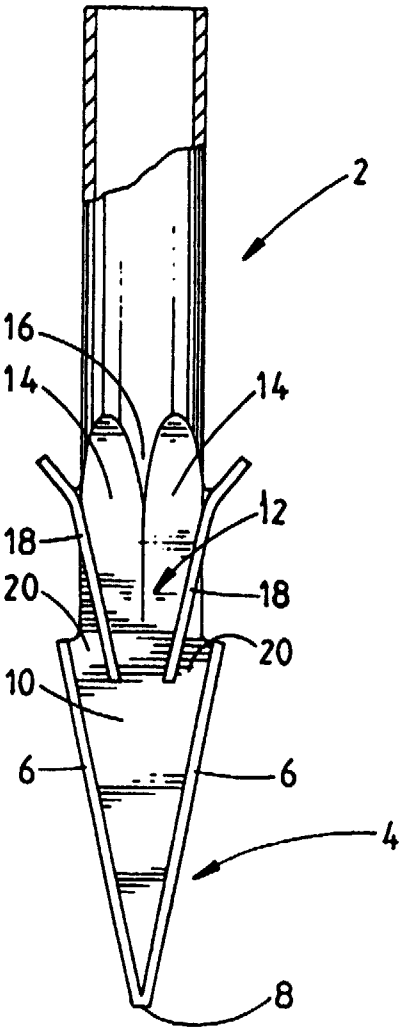
FIG. 1 is a side view of an anchorage device in accordance with the invention.
Figure 2:
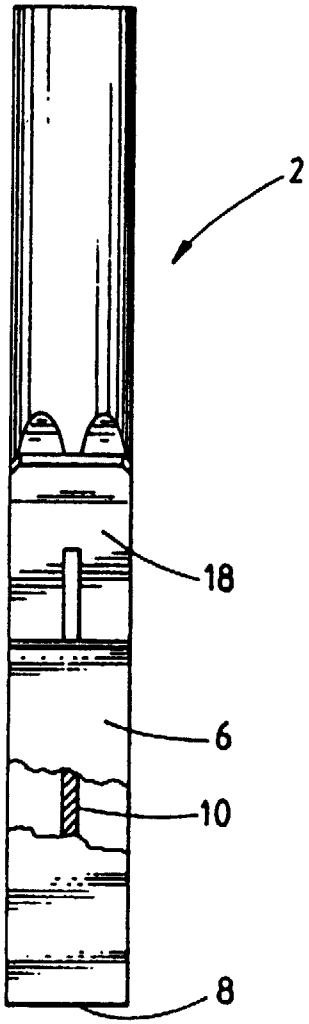
FIG. 2 is an end view of the device.
Figure 3:
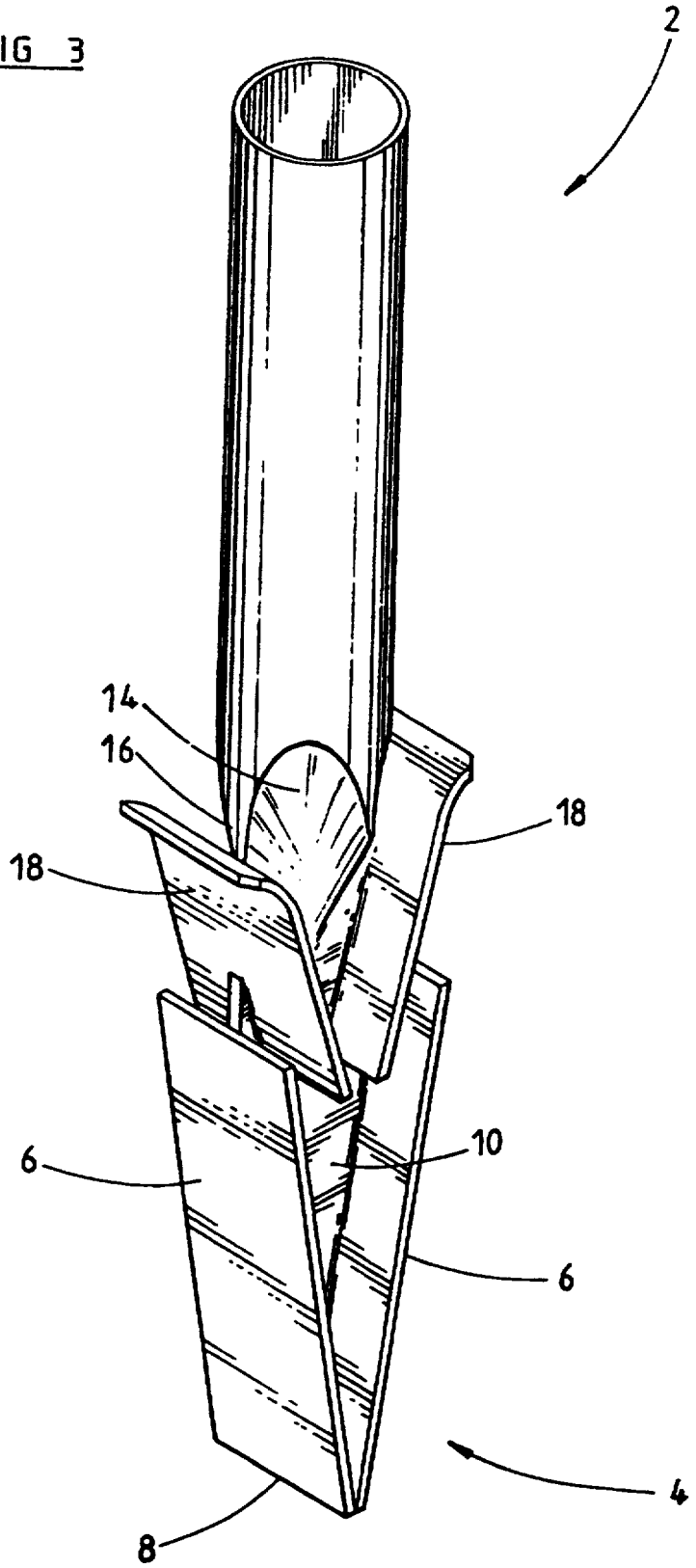
FIG. 3 is a perspective view of the device.

The anchorage device shown in the drawings comprises a tubular shank 2 leading to a spike portion 4 which can be set firmly into sand to provide a secure anchorage within the ground. The shank 2 is open at its upper end to receive the shaft of, for example, a beach umbrella. The invention is not limited to an anchorage device for umbrellas. Anchorage devices in accordance with the invention can be used for anchoring other articles or structures such as tents or fence posts. Several such anchorage devices linked by adjustable chains and incorporating ground plates within the ground in front of the shanks could be used as a ground anchorage for use in winching out a vehicle bogged within the ground.

The spike portion 4 comprises two lower substantially rectangular and planar plates 6 which converge towards a tip 8. The plates 6 are mounted at opposite edges of a planar V-shaped web 10, with the plane of each plate 6 extending perpendicularly to the plane of the web 10 and with each plate extending to both sides of the web 10. The V-shaped web 10 merges with the tubular shank via a transition section 12 comprising a series of angularly-spaced chamfers 14 inclined inwardly from the shank 2 to the web 10 whereby adjacent chamfers 14 are separated by a downwardly-directed and inwardly-inclined rib 16.

A further pair of downwardly and inwardly inclined or convergent rectangular and planar plates 18 is mounted on the web 10 above the lower plates 6. These further plates 18 have a width equivalent to that of the lower plates 6 and extend on opposite sides of the web 10, the upper ends of the plates 18 lying adjacent the upper end of the transition section 12 and the lower ends of the plates 18 being spaced and lying between the upper ends of the lower plates 6 so that the two sets of plates 6 and 18 overlap. With this configuration, channels 20 are defined at each side of the web 10 between the lower ends of the upper plates 18 and the upper ends of the lower plates 6 to feed sand from around the top of the spike portion 4 into the spike portion 4 to be contained between the inner surfaces of the lower plates 6. The upper plates 18 also act to funnel sand into the spike portion 4.

Typically the device will be used either in a beach situation where the sand is powder dry on top and wet or damp below, or in a desert or other land situation where the sand is powder dry on top and firm below. To anchor the device, the spike portion 4 is inserted into sand to a depth at which it is fully within the wet, damp or firm sand to create a triangular hole. The device is then removed to clear the spike portion of accumulated sand. The spike portion is placed back into the hole and rocked backwards and forwards in the plane of the web 10 (in other words in the plane of FIG. 1 ) with dry sand being fed into the interior of the spike portion via the channels 20. When the spike portion 4 has been sunk into the sand to a depth at which the upper ends of the upper plates 18 are submerged, continued rocking will cause further sand to funnel between the upper plates 18 into the spike portion 4 until the anchorage device is locked substantially solid within the sand. In this condition the spike portion 4 is solidly packed with sand and a solid mass of sand is formed within and around the upper plates 18.

Optimum anchorage conditions are provided wherein the spike portion 4, when fully inserted, is in wet, moist or firm sand, and when the upper ends of the upper plates 18 are below the surface within dry sand to facilitate funnelling of the dry sand into the spike portion 4 with continued rocking movement. It is believed that in the anchored condition the device is effectively embedded within a solid body of compacted sand. In use, vibrations arising from buffeting of the anchorage device under wind forces or the like has the effect of funnelling further dry sand through the upper end of the upper plates 18 to further enhance the anchorage.

The upper plates 18, in addition to providing the funnelling effect described above, also act to increase the anchorage area and hence the anchorage force provided. Preferably, and as illustrated, the upper ends of the upper plates 18 are flared outwardly. This strengthens the assembly and also increases the resistance to vertical pull. The ribs 16 defined by the chamfers 14 also act to strengthen the assembly and are believed to enhance the funnelling effect.

In use, a solid anchorage can be obtained which will resist a substantial vertical pulling force. Wind forces which will cause buffeting and vibrations will tend to increase, rather than reduce, the anchorage effect. Beach umbrellas, which are susceptible to high wind loading, can be effectively anchored by the device.

Removal of the anchorage device is effected by a series of deliberate rocking movements at right angles to the plane of the web 10.

Figure 4:
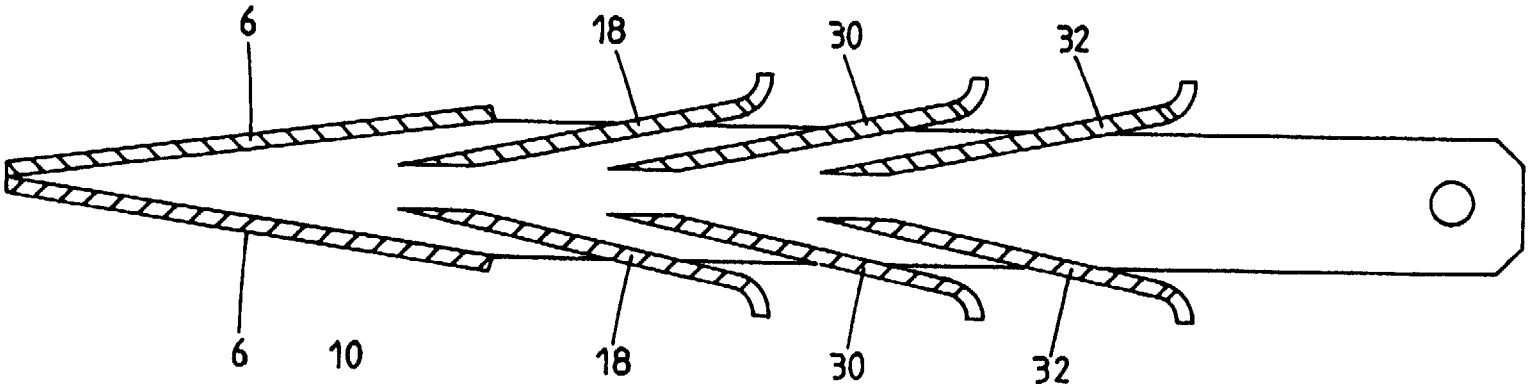
FIGS. 4 to 6 show, schematically, modified forms of the device.
Figure 6:
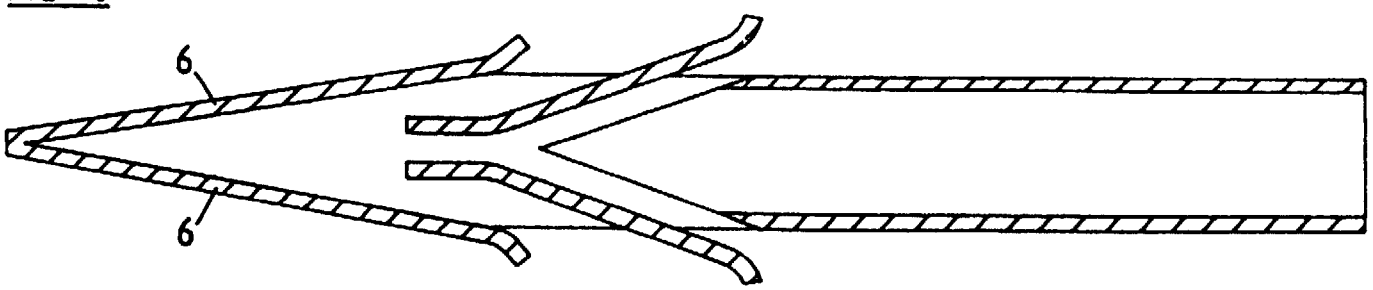
Figure 5:
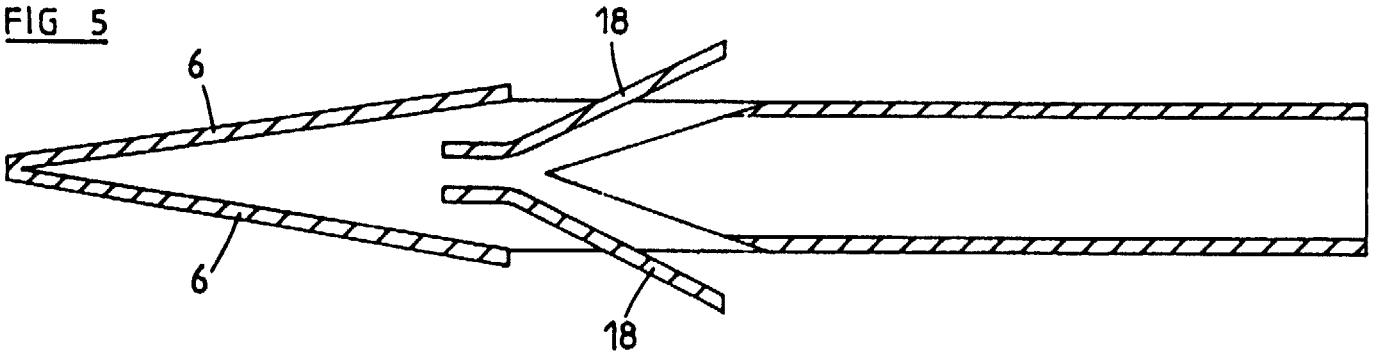

For applications where an increased anchorage is required, such as an anchorage for a fence post and/or where dry sand is likely to be encountered to a substantial depth, the length of the web 10 may be extended to carry further pairs of convergent funnelling and anchoring plates 30, 32 as shown schematically in FIG. 4, with the lower end of each pair of plates lying within the pair of next adjacent lower plates. The upper ends of the further pairs of plates may be flared outwardly for the reasons discussed previously, and/or the lower ends of the or each further set of plates may be extended longitudinally to strengthen the web as shown in FIGS. 5 and 6. The upper ends of the two plates 6 forming the spike portion 4 may also be flared outwardly as shown in FIG. 6.

The plates of the respective pairs of plates may be substantially parallel to the corresponding plate of the adjacent pair, as shown in the configurations of FIGS. 1 to 4. However, as shown in FIG. 5, the upper pair of plates may be inclined at a greater angle than the lower pair.

The shank may be formed at its upper end with an aperture or other means for securing a cable or rope of, for example, a tent or other structure. Insertion of the device into the ground can be effected by a removable handle mounted within the shank or around the shank to act as a lever by which the device can be rocked. When the device is used for mounting a beach umbrella, the shaft of the umbrella can be used for this purpose. The shank need not necessarily be of tubular form and other configurations of shank may be utilised.

The device may be fabricated from metal or may be integrally moulded from a suitable plastics.

The embodiments have been described by way of example only and modifications are possible within the scope of the invention.

I claim:

1. An anchorage device for use in sand or sandy soils, said device comprising a shank portion having opposed upper and lower ends and a longitudinal axis and a spike portion at the lower end of the shank portion, said spike portion comprising a first pair of downwardly convergent plates, said first pair of plates having upper ends and interior surfaces, said surfaces defining a zone into which sand can be fed, said device further comprising a second pair of downwardly convergent plates having upper ends at a position above the upper ends of the first plates and lower ends at a position beneath the upper ends of the first plates, said second pair of plates defining a funnel and the lower ends of said second plates defining a funnel outlet which leads into said zone so that sand within the second plates is directed into said zone between the interior surfaces of the first plates.

2. An anchorage device according to claim 1, wherein each of the plates is of substantially rectangular form.

3. An anchorage device according to claim 1, wherein the respective plates of the second pair of convergent plates are substantially parallel to a respective one of the plates of the first pair.

4. An anchorage device according to claim 1, wherein the respective plates of the second pair of convergent plates are inclined to said longitudinal axis at a greater angle than the respective plates of the first pair.

5. An anchorage device according to claim 1, wherein each of the plates is of substantially planar form.

6. An anchorage device according to claim 5, wherein the upper ends of the plates of the first and/or second pair of plates are outwardly flared.

7. An anchorage device according to claim 5, wherein the lower ends of the plates of the second pair are directly substantially parallel to said longitudinal axis.

8. An anchorage device according to claim 1, wherein the spike portion further comprises a planar web connected to the shank portion, the first pair of plates being mounted on the web, the respective plates of the first pair being at opposite sides of the web and extending perpendicularly to the plane of the web.

9. An anchorage device according to claim 8, wherein the second pair of plates is mounted on the web, the respective plates of the second pair being at opposite sides of the web and extending perpendicularly to the plane of the web.

10. An anchorage device according to claim 1, wherein the shank portion is of tubular form open at its upper end.

11. An anchorage device according to claim 1, comprising a third pair of downwardly convergent plates extending from a position above the upper ends of the second pair of plates to a position beneath the upper ends of the second plates to funnel sand between the second plates.

12. An anchorage device for use in sand or sandy soils, said device comprising a shank portion and a spike portion at a lower end of the shank portion, said spike portion comprising a first pair of downwardly convergent plates, said plates having upper ends and interior surfaces, said surfaces defining a zone into which sand can be fed, said device further comprising a second pair of downwardly convergent plates extending from a position above the upper ends of the first plates to a position beneath the upper ends of the first plates to funnel sand into said zone formed by the interior surfaces of the first plates, wherein each of the plates is of substantially rectangular form and the respective plates of the second pair of plates are substantially parallel to the respective plates of the first pair.

13. An anchorage device for use in sand or sandy soils, said device comprising a shank portion and a spike portion at a lower end of the shank portion, said spike portion comprising a first pair of downwardly convergent plates, said plates having upper ends and interior surfaces, said surfaces defining a zone into which sand can be fed, said device further comprising a second pair of downwardly convergent plates extending from a position above the upper ends of the first plates to a position beneath the upper ends of the first plates to funnel sand into said zone formed by the interior surfaces of the first plates, wherein the spike portion further comprises a planar web connected to the shank portion, the first pair of plates is mounted on the web, and the respective plates of the first pair are at opposite sides of the web and extend perpendicularly to the plane of the web.

14. An anchorage device according to claim 13, wherein the second pair of plates is mounted on the web, the respective plates of the second pair being at opposed sides of the web and extending perpendicularly to the plane of the web.

* * * * *